US006319138B1

(12) United States Patent
Fair et al.

(10) Patent No.: US 6,319,138 B1
(45) Date of Patent: Nov. 20, 2001

(54) OPEN TOP INFANT SWING

(75) Inventors: Paul Fair, Denver, CO (US); Tracy George, Huber Heights; Mark Rennie, Bradford, both of OH (US); Joe Kapushion, Erie, CO (US)

(73) Assignee: Evenflo Company, Inc., Vandalia, OH (US)

( * ) Notice: Subject to any disclaimer, the term of this patent is extended or adjusted under 35 U.S.C. 154(b) by 0 days.

(21) Appl. No.: 09/666,973

(22) Filed: Sep. 21, 2000

(51) Int. Cl.[7] ..... A63G 9/16
(52) U.S. Cl. ..... 472/119; 472/118; 297/273
(58) Field of Search ..... 472/118, 119, 472/120, 125; 297/273, 274, 276, 277

(56) References Cited

U.S. PATENT DOCUMENTS

| | | | |
|---|---|---|---|
| D. 428,268 | 7/2000 | Fair | D6/344 |
| 5,163,828 | 11/1992 | Coddington, Jr. | 472/118 |
| 5,224,902 | 7/1993 | Stremler | 472/118 |
| 5,267,906 | 12/1993 | Kitchen et al. | 472/118 |
| 5,338,260 | 8/1994 | Smith | 472/118 |
| 5,378,196 | 1/1995 | Pinch et al. | 472/119 |
| 5,449,323 | 9/1995 | Melton | 472/118 |
| 5,511,258 | 4/1996 | Barr, Sr. | 5/104 |
| 5,525,113 | 6/1996 | Mitchell et al. | 472/119 |
| 5,529,539 | 6/1996 | Hoffman | 472/118 |
| 5,573,465 | 11/1996 | Kitchen et al. | 472/118 |
| 5,707,294 | 1/1998 | Fischer | 472/118 |
| 5,769,727 | 6/1998 | Fair et al. | 472/118 |
| 5,788,014 | 8/1998 | Saint et al. | 185/43 |
| 5,791,999 | 8/1998 | Lauro et al. | 472/118 |
| 5,803,817 | 9/1998 | Stern | 472/118 |
| 5,961,390 | 10/1999 | Hoffman | 472/118 |
| 6,010,410 | 1/2000 | Lauro et al. | 472/118 |
| 6,036,605 | 3/2000 | Tseng | 472/118 |
| 6,059,667 | 5/2000 | Pinch | 472/119 |

*Primary Examiner*—Kien T. Nguyen
(74) *Attorney, Agent, or Firm*—Thompson Hine LLP

(57) ABSTRACT

The present invention is an electrically driven open top infant swing comprising a crossbar that does not extend directly over the top of the infant swing. Thus, as opposed to other prior art swing designs utilizing crossbars, the crossbar of the present invention provides excellent stability and rigidity to the swing described and claimed herein while still allowing relatively easy access to an infant seated in the swing seat. Additionally, the present invention provides an infant swing that is coupled to an electric drive motor by a "moving pivot" thereby allowing the swing to pivot independently of the drive motor and thus avoiding undue strain on the swing motor and gearing.

12 Claims, 6 Drawing Sheets

OPEN TOP INFANT SWING

BACKGROUND OF THE INVENTION

The present invention is directed to an infant swing, and more specifically to an open top, electrically driven infant swing which is stable and efficient in operation.

In the past there have been many different types of infant swings. In particular, very early on infant swings having an "A" frame configuration were very popular. In a typical swing configuration of this type, the swing structure consisted of two A shaped legs which were attached by a lateral cross bar or axle at the top vertices of the A. The swing itself was generally hung from the cross bar and a motor, usually either spring or electric, was operatively connected thereto to provide the motive force for moving the swing. In these prior configurations, the motor was usually located somewhere on one of the two leg structures, fairly close to the rotational axis of the axle. While this positioning of the motor was generally acceptable, it would be preferred, from a stability standpoint, to position the motor closer to the center of gravity of the swing, at a location generally equidistant from the respective support structures of the swing, namely the A shaped legs. An example of this type of prior art swing is shown in U.S. Pat. No. 5,378,196.

While swings of this general configuration have been popular, there are some disadvantages to these types of swings which have been addressed in more recent swing designs. In particular, while these prior art swings which incorporate an axle or crossbar to space the A shaped legs are relatively stable, the axle or crossbar tends to prevent easy access to a child located in the seat hanging therefrom. In order to overcome this problem, most of the newer swing designs tend to be "open top" designs wherein there is no crossbar or axle which runs directly across the top of the support structure over the top of the seat. These newer style "open top" swings allow much easier access to the child than the prior art swings discussed above. Examples of typical "open top" swings include U.S. Pat. No. 5,525,113 owned by Graco Children's Products, Inc., U.S. Pat. No. 5,769,727 owned by Evenflo Company Inc., and U.S. Pat. No. 5,791,999 owned by Kolcraft Enterprises, Inc. As can be seen in all of these patents, there is no axle or crossbar that extends directly over the top of the swing and stability is provided by attaching the bases of the A shaped legs, rather than the vertices of the A's as in prior art swings. While these designs have been generally effective, sometimes greater stability and rigidity than can be delivered by a swing structure having no upper crossbar or axle is desired.

Most importantly, though, it is noted that most prior art swing designs incorporate motor couplings which are directly linked to the swing itself. This type of design can successfully deliver power to the swing, but has some disadvantages. For example, the direct linkage means that if the swing is stopped or forced in the wrong direction while the motor is engaged, depending on the exact construction of the swing, the gears can be stripped or the motor can be damaged. Additionally, a direct linkage usually results in a swing motion which is rigid and fairly mechanical when it would be preferred to have a swing motion that is smoother and more pendulum like.

Accordingly, given some of the above-noted deficiencies of prior art infant swings, it would be desirable to have an infant swing including a support structure that is generally stable and allows easy access to an infant seated in the swing chair. Additionally, it would be desirable to have an infant swing that provides a novel drive and coupling system which efficiently provides a smooth, natural swing motion for an infant seated in the swing. Furthermore, it would be desirable to have a novel drive and coupling system which prevents damage to the swing motor and gear system when the motion of the swing is stopped or modified while the swing is in motion.

SUMMARY OF THE INVENTION

It is an object of the present invention to provide an open top infant swing incorporating a novel support structure that is generally stable and allows easy access to an infant seated in the swing seat. Additionally, the present invention provides a novel drive and coupling system for an infant swing which efficiently provides a smooth, natural swing motion for an infant seated in the swing. The novel drive and coupling system of the present invention is additionally characterized in that damage or stress to the swing motor and gear system is generally prevented when the motion of the swing is stopped or modified while the swing is in motion.

More specifically, the infant swing of the present invention comprises a novel support structure including a crossbar that does not extend directly over the top of the infant swing. Thus, as opposed to other prior art swing designs utilizing crossbars, the crossbar of the present invention provides excellent stability and rigidity to the infant swing described and claimed herein while still allowing relatively easy access to an infant seated in the swing seat. Preferably, the crossbar structure of the infant swing of the present invention is a relatively rigid hollow molded plastic construction thereby providing room therein for mounting a motor, gear and coupling assembly. Additionally, the present invention provides an infant swing that is coupled to an electric drive motor by a "moving pivot" thereby allowing the swing to pivot independently of the drive motor. The use of a moving pivot in this application prevents undue strain on the motor and gearing of the swing when the swing is stopped or pushed in a direction opposite of the direction of travel being induced by the motor. Additionally, the moving pivot as used in this application is useful in that the movement induced in the swing is more fluid and soothing for the infant riding therein than the movement of prior art swings utilizing direct drive mechanisms.

Accordingly, as described above, and as is shown and discussed in detail herein, it is an object of the present invention to provide an improved open top infant swing Other objects and advantages of the present invention will be apparent from the following description and the accompanying drawings.

DETAILED DESCRIPTION

Figure 1:
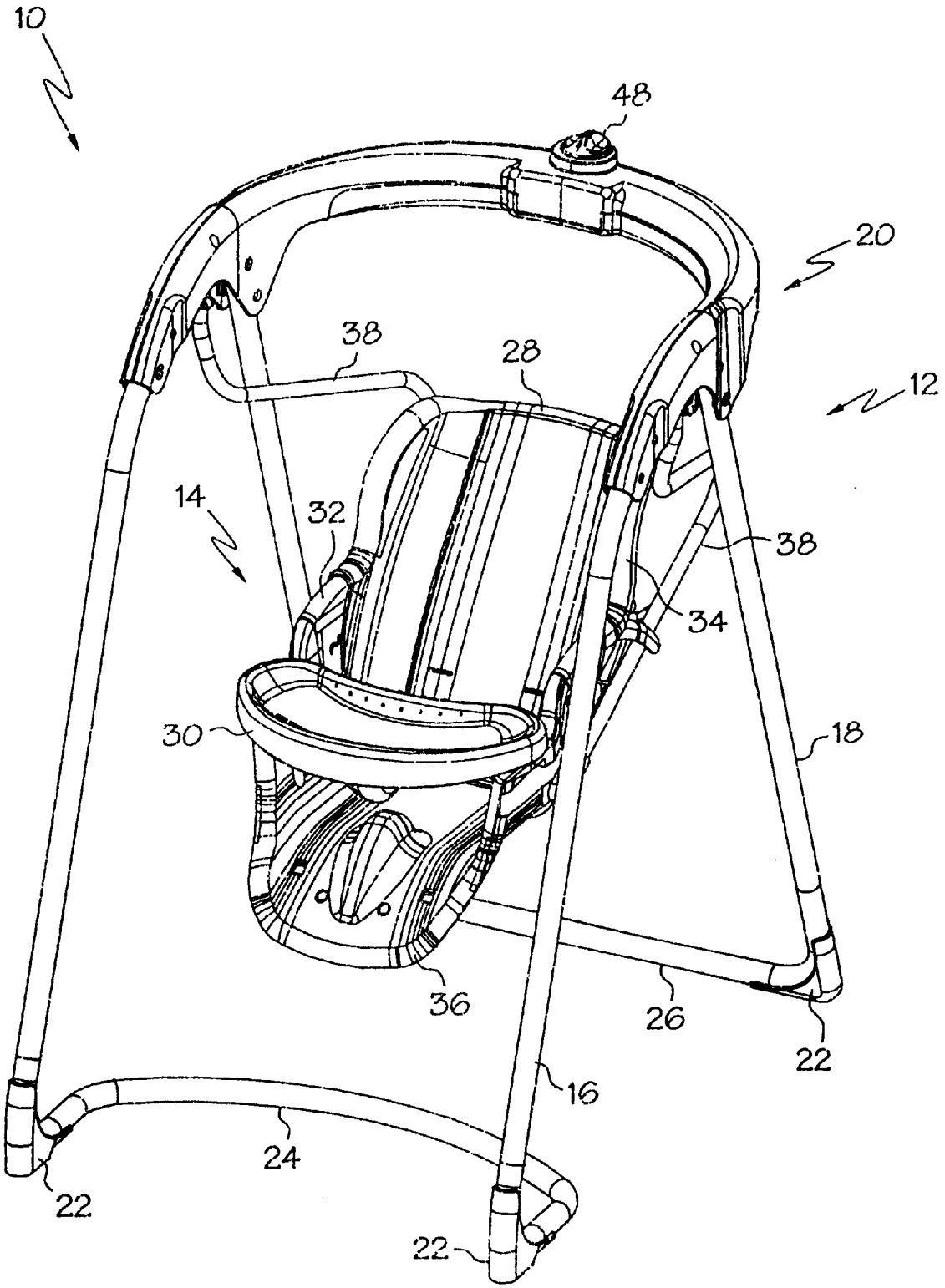
FIG. 1 is a front perspective view of an open top infant swing in accordance with the present invention.

As best shown in FIG. 1, the present invention is an open top infant swing 10 incorporating a leg and support structure 12 that is generally stable and allows easy access to an infant seated in the swing seat 14. In particular, the support structure 12 consists of a front leg component 16, a rear leg component 18 and a connection brace 20 for connecting the front leg component 16 to the rear leg component 18. In a preferred embodiment, the leg components 16, 18 are constructed of a lightweight tubular metal material, such as aluminum or steel. The leg components 16, 18 are preferably provided with feet 22 for contacting a support surface, such as a floor, and stabilizing the swing 10 thereon. Also in a preferred embodiment, the front leg component 16 includes a stabilizing crossbar 24 that extends between the left and the right sides of the front leg component and provides stability and rigidity to the swing support structure 12. Similarly, the rear leg component 18 is preferably provided with a crossbar 26 that extends between the left and the right sides of the rear leg component 18 for providing additional stability and rigidity to the swing support structure 12. A seat 28 is provided for supporting an infant and can be of any suitable construction. Preferably the seat 28 is equipped with a detachable tray 30, a padded seat cushion 32, a securing harness 34, and a leg/foot rest 36. The seat 28 hangs from a pair of support arms 38 that are pivotably attached to the connection brace 20 as will be discussed in further detail below. The support arms 38 can be constructed of any suitable material but are preferably formed of a lightweight tubular metallic material, such as steel or aluminum.

Figure 2:
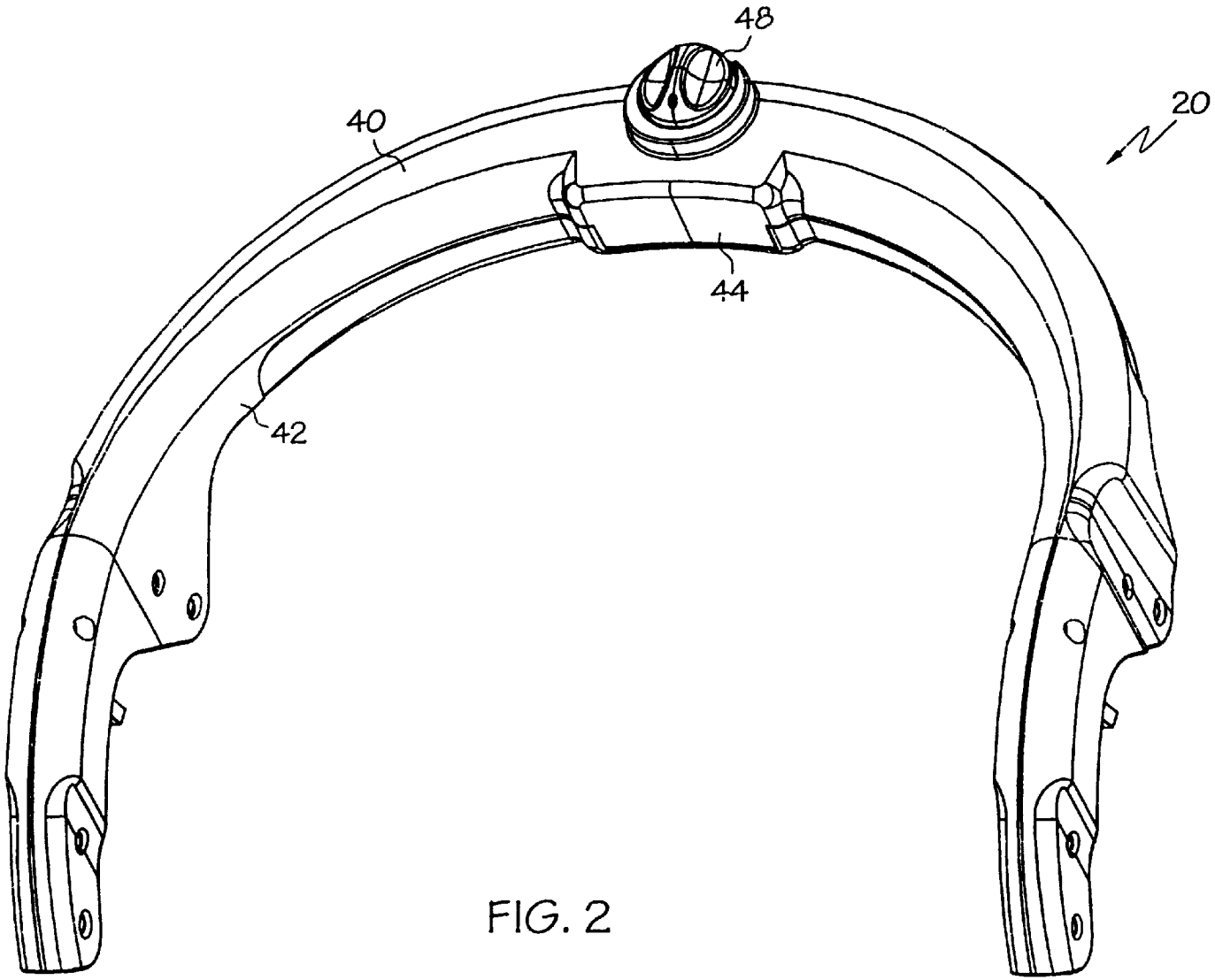
FIG. 2 is a top perspective view of a connection brace for use with the swing of FIG. 1.

As best seen in FIG. 2, the connection brace 20 of the swing support structure 12 may be made of any suitable components and materials, but is preferably made of a two-piece hollow molded plastic construction including receiving areas for the mechanical components of the swing 10. More particularly, the connection brace 20 preferably comprises an upper housing 40 and a lower housing 42 that are shaped to include a receiving area 44 for housing a motor assembly 46 (see FIGS. 6 and 7) and controls 48 therefor. While the connection brace 20 as shown herein is semi-cylindrical in shape so that it does not cross directly over the top of the seat 28, thereby allowing easy access to an infant seated therein, it is contemplated that the connection brace 20 could be other shapes, such as rectangular or a parabolic, and these shapes are considered within the scope of the present invention.

Figure 5:
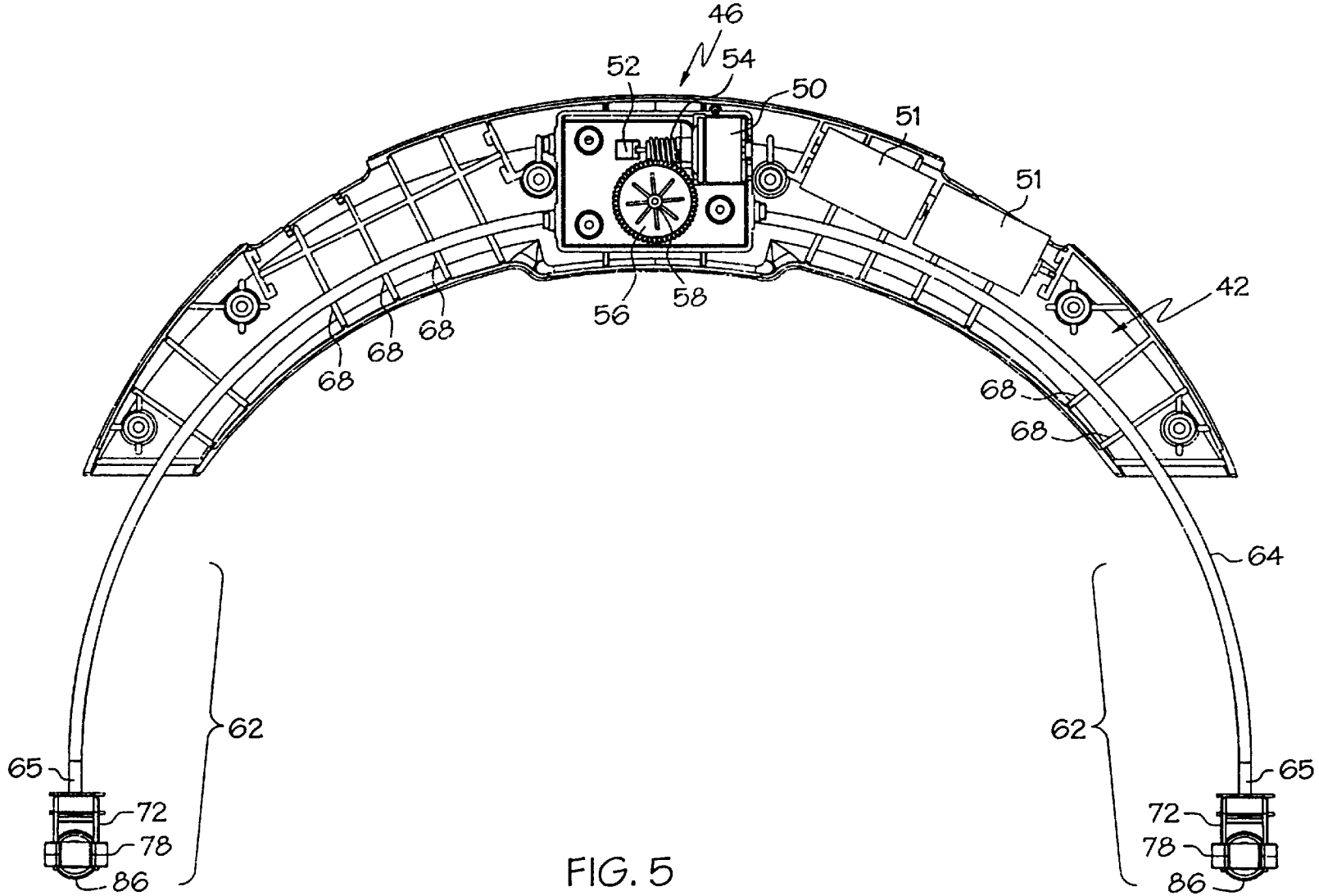
FIG. 5 is a top plan view of the lower housing of FIG. 3.
Figure 6:
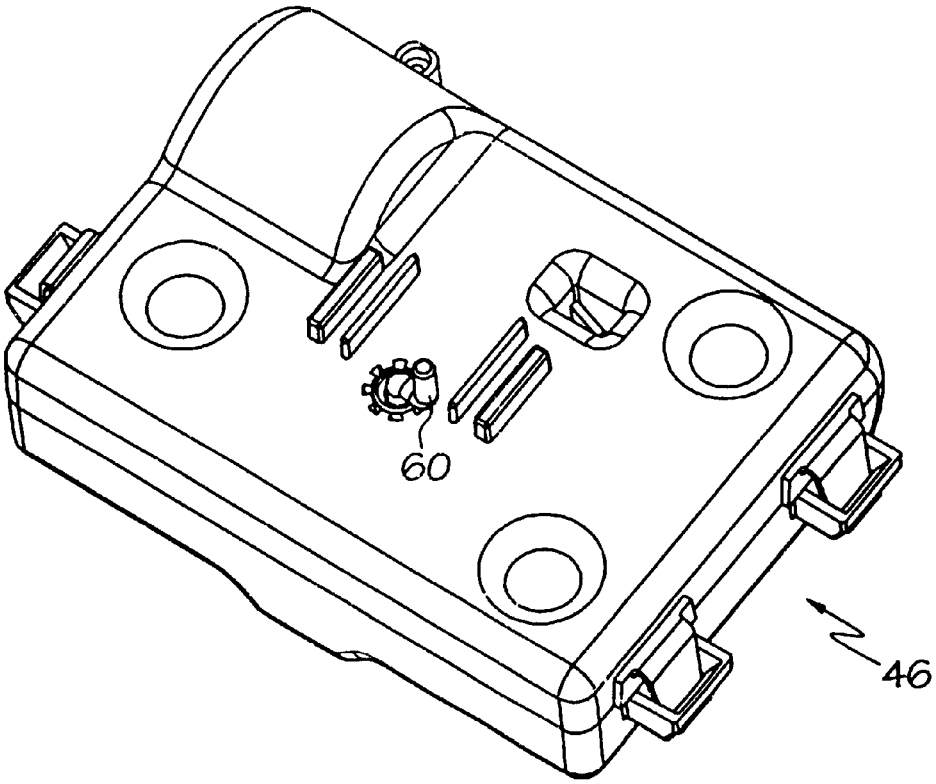
FIG. 6 is a bottom perspective view of the motor assembly as shown in the lower housing of FIG. 3.
Figure 7:
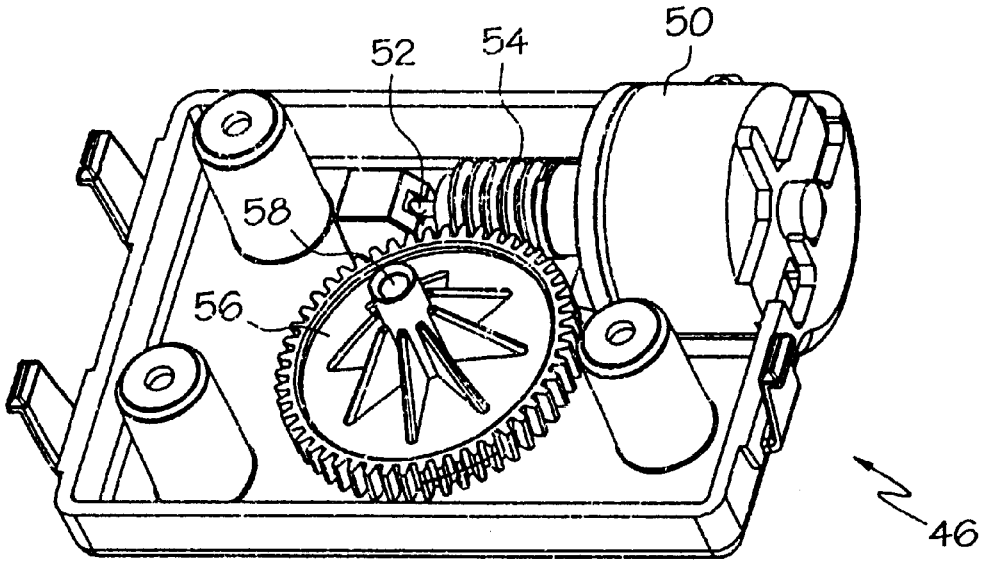
FIG. 7 is a cutaway top perspective view of the motor assembly of FIG. 6.

While many different motor assemblies could be utilized to provide the appropriate motive force for the swing 10, in a preferred embodiment, as best seen in FIGS. 6 and 7, an electric DC motor 50 is utilized. The motor 50 can be chosen from many suitable prior art designs and is preferably powered by batteries 51 (see FIGS. 3–5), although the use of AC power in connection with a transformer is also contemplated by the invention. Additionally, the motor is preferably a variable speed motor including a speed control device (not shown) operatively connected to the motor controls 48 for varying the speed of the motor 50, and thus the speed at which the seat 28 swings. In a preferred embodiment the motor 50 includes a drive axle 52 having a worm gear 54 mounted thereon. The worm gear 54 is operatively coupled to a drive gear 56 having a central axis 58. An eccentric rod 60 is mounted on the central axis 58 of the drive gear 56 such that when the motor 50 is operated the eccentric rod 60 is rotationally driven producing a circular swing path, the diameter of which is determined by the offset of the eccentric rod 60. Thus, when the eccentric rod 60 is operatively attached to the coupling system 62 that will be discussed in detail below, and the motor 50 is actuated, the motor 50 drives the swing seat 28 in a lateral swinging motion.

Figure 3:
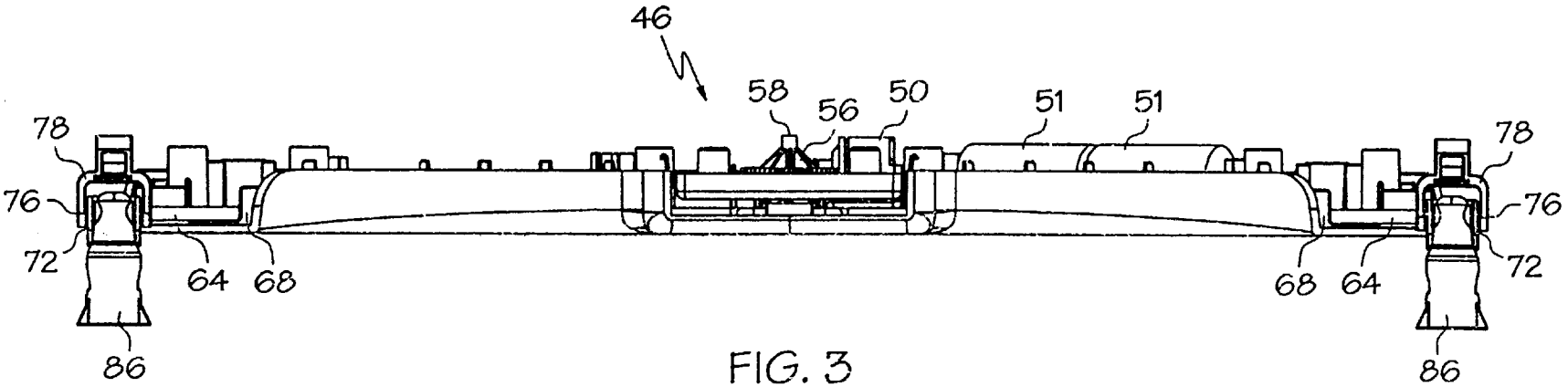
FIG. 3 is a front elevational view of the lower housing and swing coupling system of the connection brace of FIG. 2.
Figure 4:
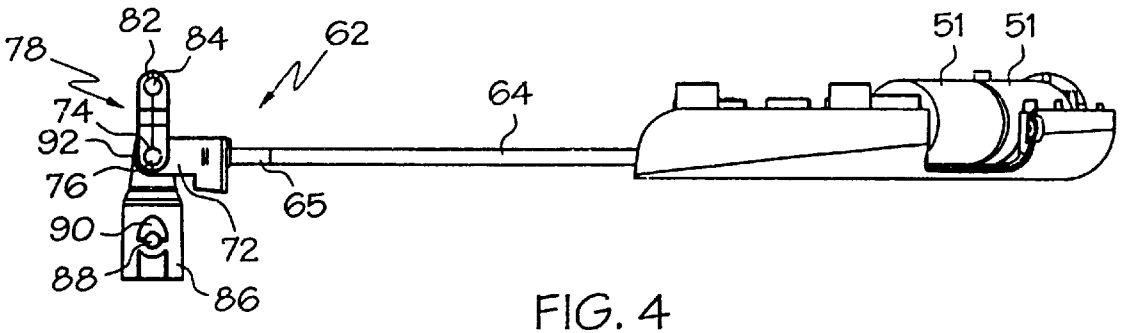
FIG. 4 is a side elevational view of the lower housing of FIG. 3.
Figure 8:
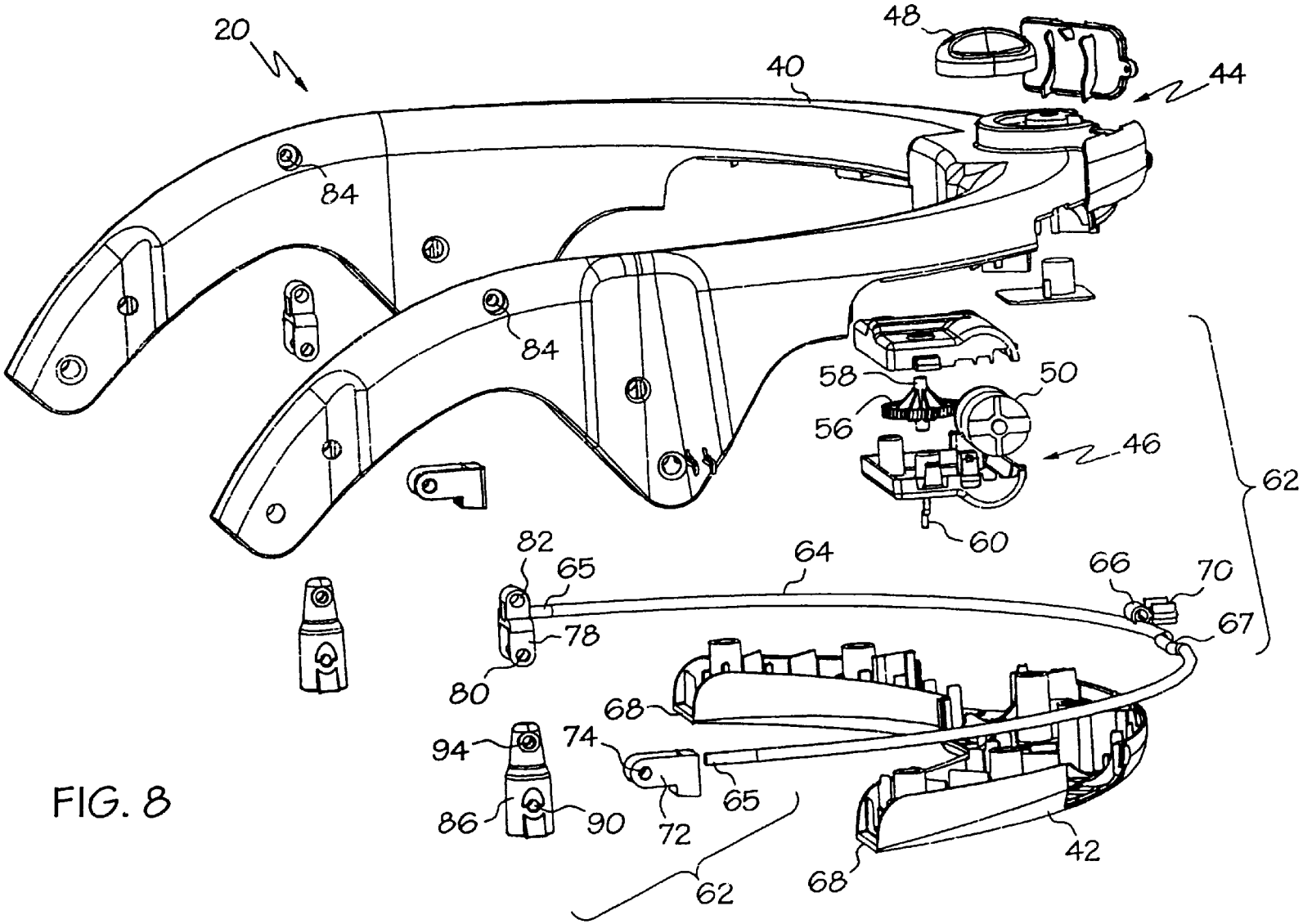
FIG. 8 is an exploded side perspective view of an alternate embodiment of a connection brace for use with the swing of FIG. 1.

As best seen in FIGS. 3–5, the lower housing 42 is shaped to receive the motor assembly 46 as well as the coupling system 62. As mentioned above, the coupling system 62 is used to couple the motor assembly 46 to the swing seat 28 to provide the motive force for the swing 10. The coupling system 62 is made up of several components which operate to transfer the rotational force delivered from the motor 50 through the eccentric rod 60 to swing the seat 28. Specifically, as best seen in FIGS. 5 and 8, a semi-cylindrical drive rod 64, including ends 65 and mid-point 67, is positioned in a track 68 in the lower housing 42 connection bracket 20. A drive bracket 66 is fixedly attached to the drive rod 64 mid-point 67 and the drive bracket 66 includes a slot 70, preferably rectilinear in shape, formed therein for receiving the eccentric rod 60. The drive bracket 66 is positioned and attached to the drive rod 64 such that rotation of the eccentric rod 60 in the slot 70 causes the drive rod 64 to oscillate in a linear-horizontal direction in the track 68 with respect to the swing 10.

The ends 65 of the drive rod 64 are attached to pullers 72. Each puller 72 includes coaxial apertures 74 on either side thereof for receiving a lower pivot axle 76. The lower pivot axle 76 is a stub axle and is not fixedly attached to the swing support structure 12 thereby providing the "moving pivot" discussed above. The "moving pivot" is attached to the swing support structure 12 by a pivot hanger 78. The pivot hanger 78 includes coaxially spaced lower apertures 80 for receiving the lower pivot axle 76 and coaxially spaced upper apertures 82 for receiving the upper pivot axle 84. The upper pivot axle 84 is anchored into the connection brace 20 and allows the pullers 72 to move the swing seat 28 connected thereto. More specifically, the seat 28 has swing arms 38 connected thereto and extending upwardly therefrom which support the seat 28. The swing arms 38 are fixedly attached into the swing arm sleeves 86 by pins 88 through apertures 90. The upper ends of the swing arm sleeves 86 include coaxially spaced apertures 94 for receiving the lower pivot axle 76. Accordingly, the hangers 78 and swing arm sleeves 86 both pivot coaxially around the lower pivot axle 76.

Thus, when the pullers 72 are oscillated backward and forward by the ends 65 of the drive rod 64, the swing arms 38, and thus the seat 28 attached thereto, will generally be pivoted roughly about the upper pivot axle 84. However, since the swing arm sleeves 86 are fixedly attached only to the swing arms 38, while being pivotably attached to the lower pivot axle 76, the swing arms 38, and thus the swing seat 28, can pivot independently of the upper pivot axle 84. Accordingly, when motion of the swing seat 28 is stopped or reversed by an outside force, the swing seat 28 can pivot about the lower pivot axle 76 while the pullers 72 are actually pulling (or pushing) the swing arm sleeves 86 in the opposite direction. In this manner, stripping of the motor assembly 46 gears or strain on the motor 50 that would normally occur in such a situation is ameliorated. Furthermore, given that the swing seat 28 is pivoting on not one but two separate axles, the pivoting motion is smoother and more comfortable for an infant seated in the seat 28.

Having described the invention in detail and by reference to the preferred embodiments, it will be apparent that modifications and variations thereof are possible without departing from the scope of the invention.

What is claimed is:

1. An open top infant swing comprising:

a seat having at least one swing arm extending therefrom;

a support structure for supporting said seat;

a motor for oscillating said seat, said motor operatively connected to a drive rod, said drive rod having a middle section and at least one end, and said drive rod further including pullers positioned on the ends thereof;

a hanger having an upper end and a lower end wherein said hanger upper end is pivotably connected to said support structure, and wherein said hanger lower end is pivotably connected to said puller and said swing arm such that said swing arm can pivot independently of said hanger and said puller.

2. The infant swing of claim 1 wherein said drive rod includes a drive bracket affixed proximate a mid-point thereof, said drive bracket including a slot for receiving an eccentric rod operatively connected to said motor so that when said rod is rotated said drive rod is oscillated in a direction generally horizontal to said support structure.

3. The infant swing of claim 2 wherein said slot is rectilinear in shape.

4. The infant swing of claim 1 wherein said motor is an electric DC motor.

5. The infant swing of claim 4 wherein said motor includes a drive axle having a worm gear mounted thereon, said worm gear being operatively coupled to said drive gear, and said drive gear including an eccentric rod attached thereto.

6. The infant swing of claim 1 wherein said drive rod is generally semi-cylindrical in shape and includes two ends attached to two pullers.

7. The infant swing of claim 1 wherein said drive rod is generally parabolic in shape and includes two ends attached to two pullers.

8. An open top infant swing comprising:

a seat having at least one swing arm extending therefrom;

a support structure for supporting said seat, said support structure including a generally "U" shaped front leg component and a generally "U" shaped rear leg component, wherein the bottoms of said "U" shaped front and rear leg components are shaped for contacting a support surface and wherein the tops of said "U" shaped front and rear leg components are connected by a single generally semi-cylindrical connection brace which connects the front and rear leg components and does not extend over the top of said seat when said seat is in a resting position.

9. The open top infant swing of claim 8 wherein said front and rear leg components each include a pair of feet attached thereto for stabilizing said support structure with respect to a support surface.

10. The open top infant swing of claim 8 wherein said connection brace is hollow and includes recesses therein for receiving a swing motor and coupling mechanism.

11. A coupling system for an infant swing comprising:

a fixed upper pivot axle, a movable lower pivot axle, a hanger pivotably coupled to said upper pivot axle and including said lower pivot axle wherein said hanger is shaped to receive an effective end of a swing arm attached to an infant swing seat;

a drive rod operatively coupled to a motor, said drive rod including a puller attached proximate an end thereof;

wherein said swing arm is pivotably coupled to said lower pivot axle and said puller is coupled to said hanger such that when said drive arm is oscillated said hanger pivots about said upper pivot axle.

12. An open top infant swing comprising:

a seat having at least one swing arm extending therefrom;

a support structure for supporting said seat, said support structure including a generally "U" shaped front leg component and a generally "U" shaped rear leg component, wherein the bottoms of said "U" shaped front and rear leg components are shaped for contacting a support surface and wherein the tops of said "U" shaped front and rear leg components are connected by a single generally semi-cylindrical connection brace which connects the front and rear leg components and does not extend over the top of said seat when said seat is in a resting position;

a DC electric motor for oscillating said seat, said motor including a drive axle operatively coupled to a worm gear, said worm gear operatively coupled to a drive gear, said drive gear being operatively connected to an eccentric rod, said eccentric rod being seated in a slot in a drive bracket wherein said drive bracket is attached to a drive rod, said drive rod having a middle section and at least one end, and said drive rod further including pullers positioned on the ends thereof;

a hanger having an upper end and a lower end wherein said hanger upper end is pivotably connected to said support structure, and wherein said hanger lower end is connected to said puller and pivotably connected to said swing arm such that said swing arm can pivot independently of said hanger and said puller.

* * * * *